United States Patent [19]

Ragettli

[11] 4,255,860

[45] Mar. 17, 1981

[54] CALIBRATING APPARATUS FOR INSIDE AND OUTSIDE SURFACES AND ALIGNMENT OF PIPE SECTIONS

[76] Inventor: Christian Ragettli, Altstetterstrasse 149, Zurich, Switzerland, 8048

[21] Appl. No.: 30,752

[22] Filed: Apr. 17, 1979

[30] Foreign Application Priority Data

Apr. 18, 1978 [DE] Fed. Rep. of Germany ..... 2816722

[51] Int. Cl.[3] ..... G01B 7/12

[52] U.S. Cl. ..... 33/143 L; 33/178 E; 33/148 H

[58] Field of Search ..... 33/143 L, 147 L, 148 H, 33/178 E, 174 P

[56] References Cited

U.S. PATENT DOCUMENTS

| | | | |
|---|---|---|---|
| 2,519,221 | 8/1950 | Bogen et al. | 33/178 E |
| 3,568,485 | 3/1971 | Mandula, Jr. | 33/147 L |
| 3,892,043 | 7/1975 | Bonikowski | 33/143 L |
| 4,071,958 | 2/1978 | Morita et al. | 33/DIG. 2 |

*Primary Examiner*—Willis Little

*Attorney, Agent, or Firm*—Abraham A. Saffitz

[57] ABSTRACT

A calibrating unit for pipe sections is provided with calibrating jaw means and brake means, the jaw means measuring the inside and outside diameter of the pipe which is used in combination with feed rolls and tilting tables which move the pipe sections into the calibrating unit. The feed rolls are synchronized with the brake means and are swivelably connected in the vertical plane onto the tilting tables with the calibrating jaw means located on both sides of the horizontal plane of said tables through which the pipe sections are moved by the feed rolls and in which horizontal plane these pipe sections are aligned by said calibrating jaw means.

14 Claims, 9 Drawing Figures

CALIBRATING APPARATUS FOR INSIDE AND OUTSIDE SURFACES AND ALIGNMENT OF PIPE SECTIONS

CROSS REFERENCE TO RELATED APPLICATION

Applicant makes reference to his German Patent Application No. P 28 16 722.8 filed Apr. 18, 1978 in Germany and claims priority thereunder in accordance with 35 U.S. C 119.

BACKGROUND OF THE INVENTION

1. Field of the Invention

This invention relates to apparatus for the calibration and alignment of pipe sections which are manufactured by automatic pipe making and cutting machinery and particularly to calibrating units having calibrating jaw means for calibrating the inside and outside dimensions of uniform length sections of pipe fed into the unit by means of feed rolls.

2. Description of the Prior Art

Pipe calibrating apparatus is known which comprises a central calibrating unit fed on one side thereof by feed rolls and connected on the other side thereof to a discharge device which delivers the calibrated pipe sections to delivery and storage. The feed rolls of the known device deliver 8 to 10 meter long pipe sections to the central calibrating unit wherein a pair of calibrating jaws close from an open position to make the measurement of the selected pipe sections. Calibration is recognized as an accepted and essential step in the manufacture of pipe because pipe sections are not straight but curved, to a greater and lesser degree, when received in the manufactured state and the straightening of the pipe, as received from production, has been a problem which the pipe industry has had to face to achieve the desired end of producing pipe in accurate tolerances for inside and outside diameters.

The requirements to approximate the ideal dimensions of roundness and diameter are particularly important in pipe which is to be used under high pressure conditions and especially in oil pipelines where thinned sections, or non-rounded sections, lead to conditions of overstrain and failure under high pressure conditions encountered in service.

To achieve the desired reliability, accuracy and efficiency in the known calibrating machines it has been found that one of the operating problems to be overcome is to compensate for nonalignment of successive pipe sections being calibrated in the central calibrating unit using calibrating jaws. Specifically the opening and closing movement of the jaws which occurs instantaneously upon encirclement of the pipe section by the jaws creates an overstrained condition and excess stresses in the pipe itself as well as in the calibrating jaws which surround the pipe. This overstrained condition results from excessive bending stresses and jaw contact pressures. In some instances the pressures are so excessive that the jaws and its mechanism are damaged.

OBJECTS OF THE INVENTION

It is an object of the invention to provide a novel calibrating apparatus for measuring the inside and outside diameters of pipe sections which are from typical production and to measure the alignment of these sections, e.g., the presence or absence of undesired curvature or deviation from the desired round cross-section, which, used with feed rolls and a tilting table, will avoid the overstrained conditions encountered in the operation of the prior art calibrating devices and will overcome these undesired conditions by providing a novel means which block the overstressed condition by slowing the movement of the jaws and by using the measurement of alignment as a means to control the calibrating operation in a manner to avoid damage to the apparatus.

It is a further object of the invention to provide novel adjustment means to improve the calibration of the apparatus provided with calibrating jaw means for pipe sections moved on a tilting table by means of feed rolls, the novel adjustment means including hydraulic or pneumatic means to adjust the vertical level of the feed rolls which includes a new mounting for these feed rolls which is swivelable in the vertical plane to coact in synchronous fashion which is, at the same time, shiftable with respect to the horizontal surface of the tilting table on which the calibration measurement is made.

A still further object of the invention is to provide an improvement in reliability and effectiveness of calibration by including blocking means to stop the rapid closing movement of the calibrating jaws which is assured at the moment of closing contact of the jaws against the pipe section thereby eliminating overstraining the jaws, the new blocking means permitting the essential prealignment of the pipe sections axially, for those pipe sections being introduced, and cooperating with the already aligned pipe sections for which the calibrating measurements have been made.

Another object of the invention is to provide a mechanism which controls the closing movement, in a series of closing steps, of the calibrating jaws, the later steps being shorter in distance and slower in rate.

Other and further objects of the invention will become apparent from the summary of the invention, drawings and more detailed description of the preferred embodiment.

SUMMARY OF THE INVENTION

The foregoing objects are achived in accordance with the invention by providing novel adjustment, control and sensing means for slowing down and controlling in an entirely new manner the movement of the standard 8 to 10 meter long pipe sections through the feed rolls, over the tilting table into the calibrating jaws and finally out of the discharge means whereby both measurement operations and alignment operations are synchronized to provide new and improved results. The new adjustment control and sensing means include an adjustable mounting means which adapts the feed rolls and the calibrating jaw means to a new cooperation wherein a swivelable mount is provided for the feed rolls. A hydraulically adjustable pair of cylinder and piston means is provided to control the pressure of the feed rolls and sensor means on the tilting table are provided to detect the pressure on the pipe at the calibrating station. This combination of mount, sensor means and pair of cylinder/piston means aids in feed back control to the cylinder/piston means while at the same time the sensor means responds to the pressure which may be exerted by the pipe encircling jaws of the calibrating jaw means. Further, braking means are provided for stopping the tilting table which braking means responds to the above mentioned sensor means at the calibration station on the tilting table. The braking means includes a secondary connection means to the tilting table which is adapted to stop the closing movement of the calibrating jaws whenever the tilting table movement is blocked. By aligning the discharge means with the calibrating jaw means there is provided the necessary alignment arrangement of feed rolls, tilting table, and calibrating jaw means along a common horizontal axis with the discharge means. A centering rope is extended along the common longitudinal axis which facilitates alignment of an incoming pipe section to the calibrating station.

Further adjustment of the pipe movement is provided by barrier means which slows the feeding action. In a preferred embodiment the cylinder/piston means comprises a double cylinder in which one cylinder provides a thrust from its piston rod which is weaker than that of the other cylinder and piston means whereby the feeding action of the pipe section is slowed and further slow-down is permitted by the barrier means. In this preferred embodiment the jaws of the calibrating jaw means are provided with sensors to register jaw pressure and the unblocking movement of the tilting table is controlled by these sensors. At the critical location, in the calibrating zone, a proximity fuse on the jaws prevents the jaws from closing in on the pipe while excess pressure is avoided after contact is made by blocking any tilting movement after alignment has taken place, this alignment being a necessary condition for reliable calibration. The resulting jaw movement is a new, controlled, adjusted movement which responds to preset pressures and proceeds at a slower rate of closing calibration as the adjustment become finer.

BRIEF DESCRIPTION OF THE DRAWINGS

A preferred embodiment of the invention is illustrated in the attached drawings in which.

DESCRIPTION OF THE PREFERRED EMBODIMENT

Figure 1:
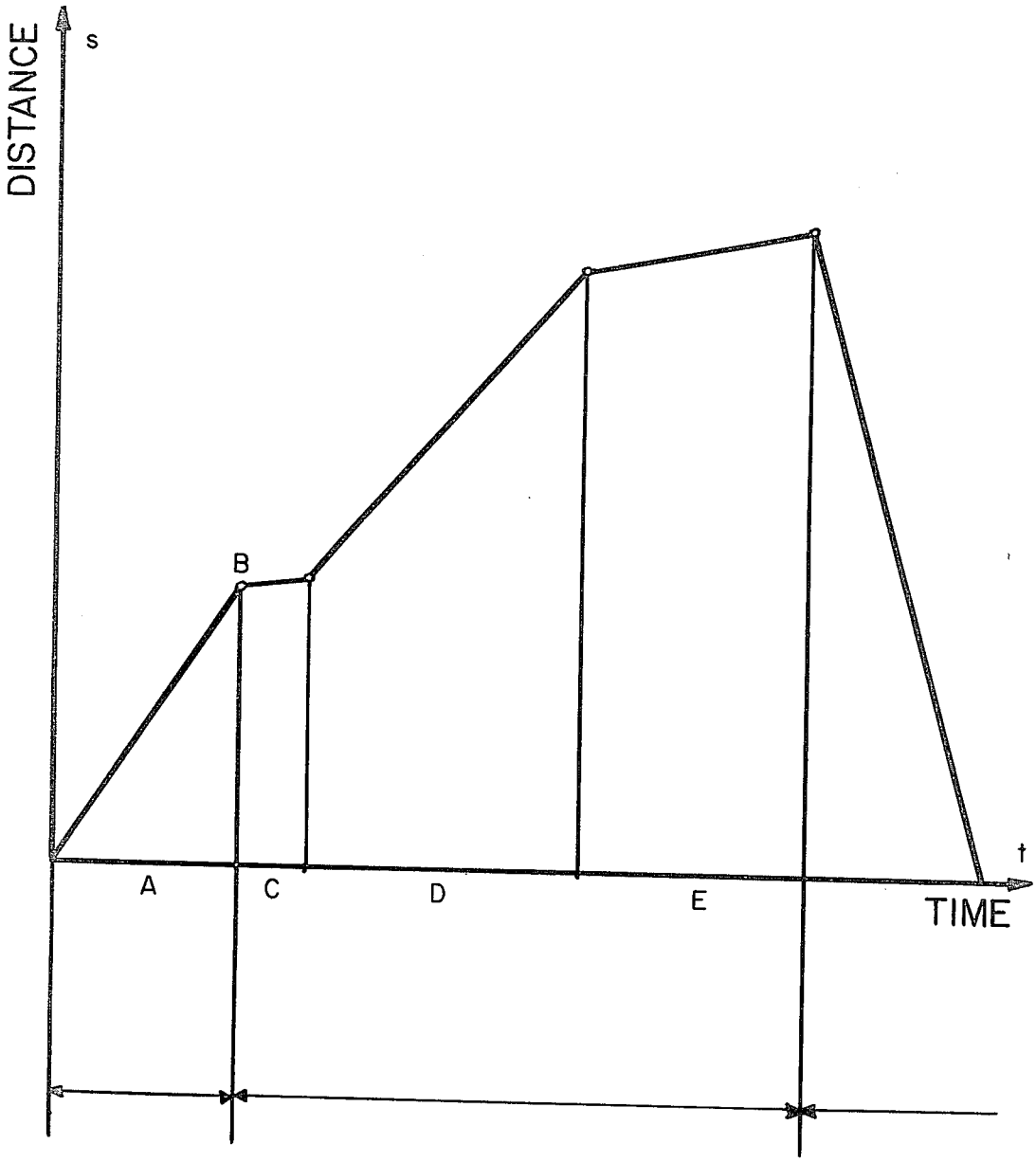
FIG. 1 is a graph showing, on the Y axis, the distance units travelled by the jaws, and on the X axis, the time units for such travel at 5 different stages.

As is clear from FIGS. 2 through 7, the apparatus for inside and outside calibrating and alignment of pipe sections has a central calibrating unit 1 which has calibrating jaws 3 disposed radially in a frame around the center axis 3 of which only two opposing jaws are shown schematically. Each calibrating jaw is equipped with two sensors 4. The calibrating jaws 3 are jointly shiftable in opening or closing movement in a radial direction whereby the diameter dimension of the jaws measuring a pipe installed in the direction of feed is reduced due to both the closing movement and compression of the jaws 3. A pipe which is not quite round is aligned correspondingly by the mechanism shown in FIGS. 8 and 9. The joint drive mechanism of the jaws 3 is not shown in FIGS. 2 through 7.

Feed rolls 6, which are supported by double cylinders 7 and which are adjustable in height, are provided for the reception and conveyance of pipe section 5 which is to be calibrated and aligned. The double cylinders 7 are disposed vertically and are provided with pistons 8 and 9 equipped with piston rods 10 and 11 extending up or down. The piston rods 11, extending downwardly and connected to the pistons 9, are supported at their other ends by a base plate 12 while each oppositely directed piston rods 10 of the pistons 8 carries a feed roll 6.

A supporting roll 16 is disposed directly in front of the calibrating unit 1 which is supported by means of a single action cylinder 13 and piston 14, aided by piston rod 15. The cylinder 13 is suppoted on the base plate 12 by means of a fixed bar 17.

Figure 2:
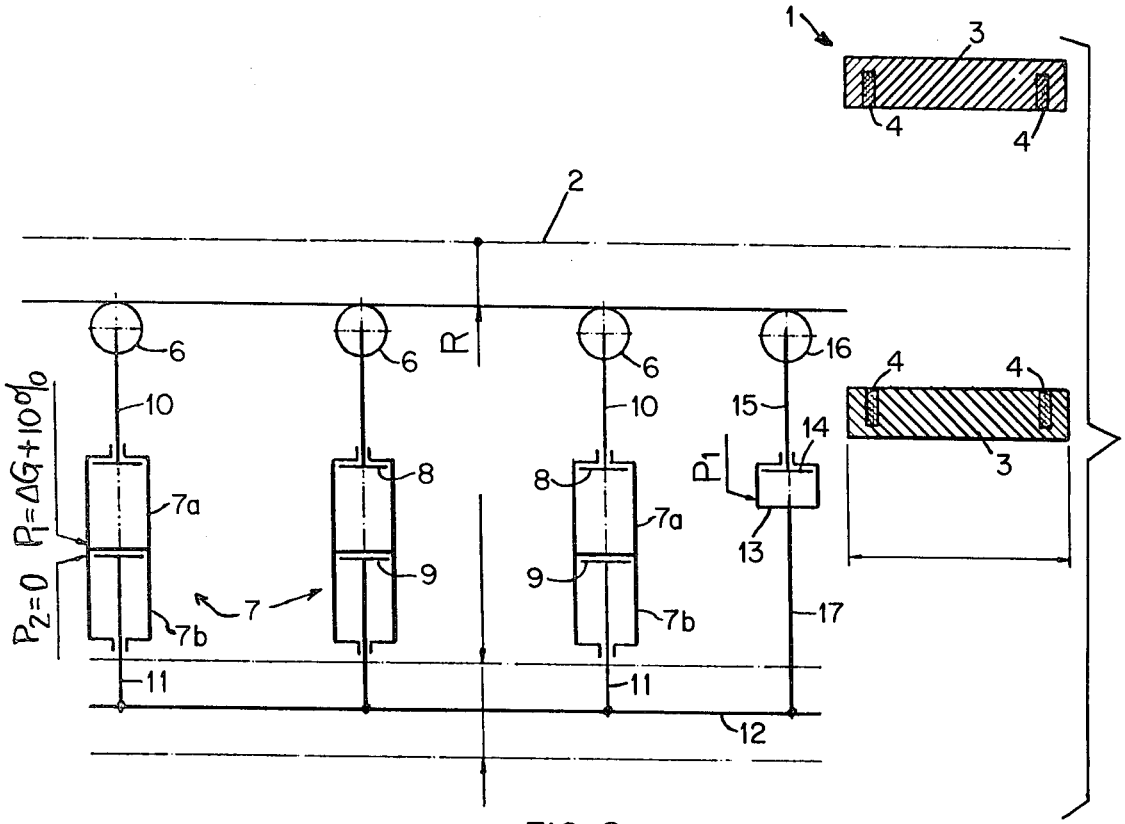
FIG. 2 shows a diagrammatic view, partly in section, indicating the relative placement of the calibrating jaws to the pipe section and the cylinder/piston arrangement for a straight pipe section.
Figure 3:
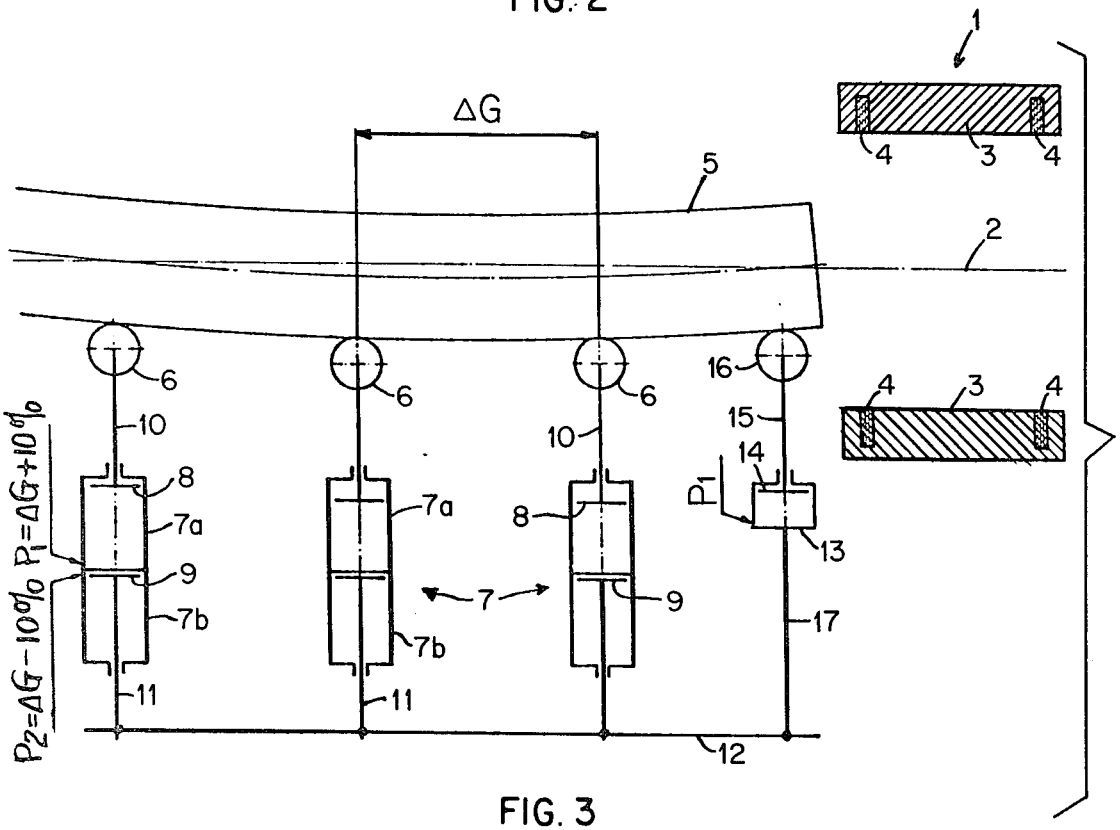
FIG. 3 shows a diagrammatic view, partly in section, indicating the relative placement of the calibrating jaws to the pipe section and the cylinder/piston arrangement for a curved pipe section.
Figure 4:
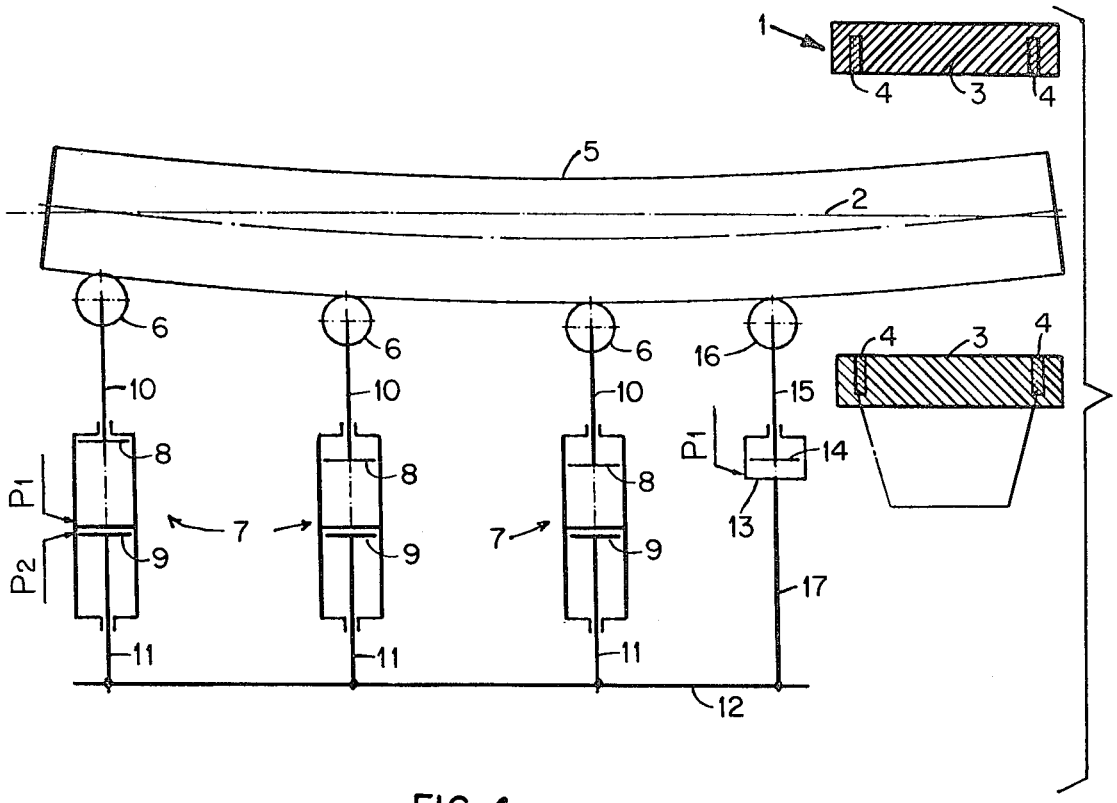
FIG. 4 shows a diagrammatic view, partly in section, indicating the relative placement of the calibrating jaws to the pipe section and the cylinder/piston arrangement for a curved pipe section with the jaws open.
Figure 5:
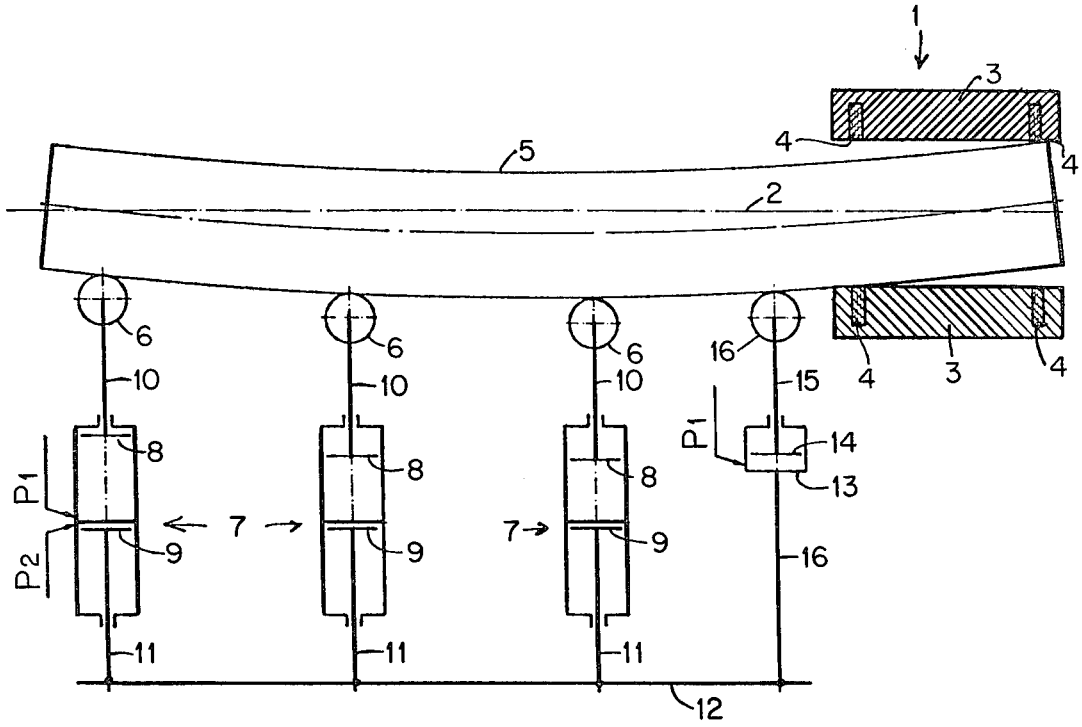
FIG. 5 shows a diagrammatic view, partly in section, indicating the relative placement of the calibrating jaws to the pipe section and the cylinder/piston arrangement for a curved pipe section with the jaws closed but not completely touching.
Figure 6:
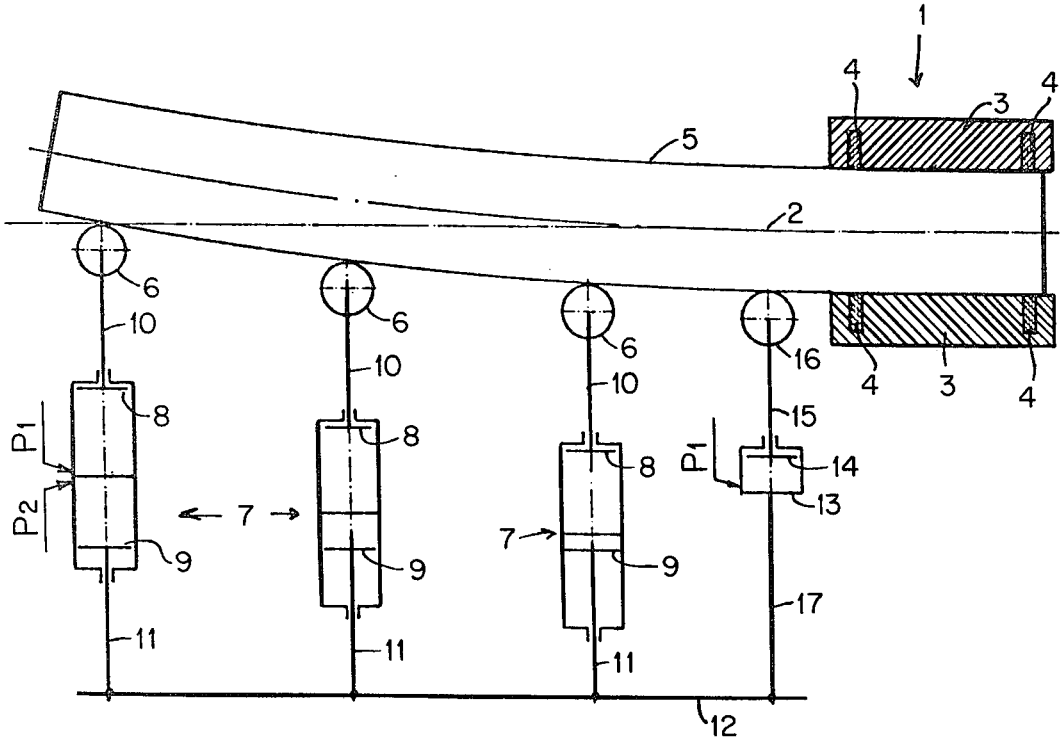
FIG. 6 shows a diagrammatic view, partly in section, indicating the relative placement of the calibrating jaws to the pipe section and the cylinder/piston arrangement for a curved pipe section with the jaws closed and with the other end of the pipe up.
Figure 7:
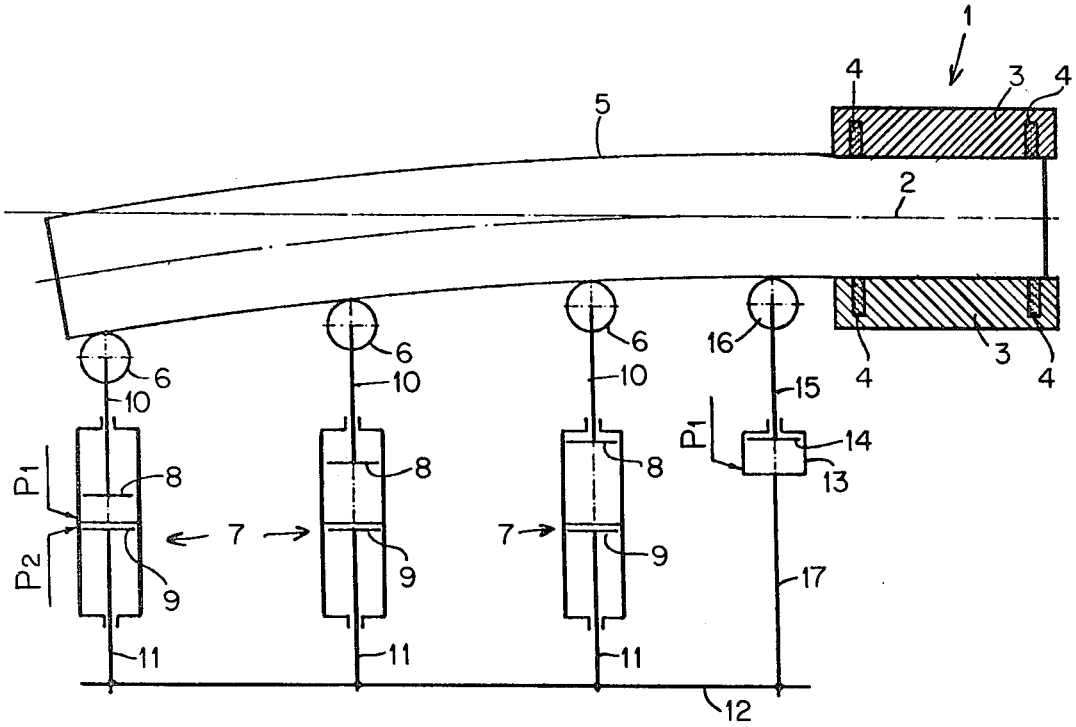
FIG. 7 shows a diagrammatic view, partly in section, indicating the relative placement of the calibrating jaws to the pipe section and the cylinder/piston arrangement for a curved pipe section with the jaws closed and with the other end of the pipe down.

FIG. 2 shows the position of the feed rolls 6 before they are fed with a pipe section. First the height of the base plate 12 is adjusting corresponding to the pipe diameter so that the feed rolls 6 and the supporting roll 16 are aligned for the reception of the pipe section. The load which may be absorbed by each of the feed rolls 6 corresponds to the load to be borne. For a total weight of the pipe which is designated by G there will be a partial load of $\Delta G$ for each feed roll which corresponds to the weight of a pipe section portion between two feed rolls 6. The pressure in the upper cylinders **7*a* is limited to a load of $\Delta G+10\%$ while the lower cylinders 7*b* are kept pressure-free. In the unloaded position, the pistons 9 will abut in each of the pressure-free cylinders 7*b* against the separating wall 18 while the upper pistons 8, because of the pressure $\Delta G+10\%$ prevailing in the upper cylinders 7*a*, assume the upper dead center position (see FIG. 2). The feed rolls 6 are then loaded with the pipe section 5 to be calibrated and aligned. The lower cylinders 7*b* are simultaneously acted upon with a pressure of $G+10\%$. Since the pipe section 5 is bent, the weight distribution on the feed rolls 6 becomes uneven. The feed rolls 6 adjust themselves to the bend of the pipe section 5 and the pipe section 5 is advanced by the feed rolls 6 so that it arrives with its end between the open calibrating jaws 3 (see FIG. 4). The height position of the feed rolls 6 remains unchanged as shown in FIG. 3**.

The calibrating jaws 3 are then moved together, at first at a great speed, until two opposite sensors 4 touch the pipe section 5. The contact of the sensors causes the radial closing movement of the calibrating jaws 3 to be instantly arrested. Immediately thereafter the closing movement of the calibrating jaws 3 is resumed but at a substantially slower speed until the position illustrated in FIGS. 6 and 7 has been reached.

In this position, i.e., when the sensors 4 touch the end of the pipe section 5, a bending movement will take place on the pipe section 5 during the closing movement and if l=length of pipe section e=distance of the pipe center axis from the carrying shaft G=weight of the pipe section t=aligning time while the end of the pipe section passes through distance e g=gravitational acceleration then $$M=2leG/3t^2g$$

From the above formula it is clear that the movement will be substantially reduced by a slowing down of the closing movement with increasing time. Before the calibrating jaws open again, all valves of the double cylinders 7 are closed so that the pipe section 5 remains in the assumed position.

The pipe section 5 is further conveyed by feed rolls 6 by the same amount as the length of the calibrating jaws 3 and said jaws 3 are subsequently closed in two steps, as described. Until pipe section 5 touches the sensors 4, the valves of the double cylinders remain closed. Upon contact, the valves of the double cylinders 7 are opened and the closing movement of the calibrating jaws 3 is continued at a substantially slower speed.

In this way the strain on the pipe section to be calibrated and aligned is greatly reduced. At the same time the calibrating apparatus is spared.

Figure 8:
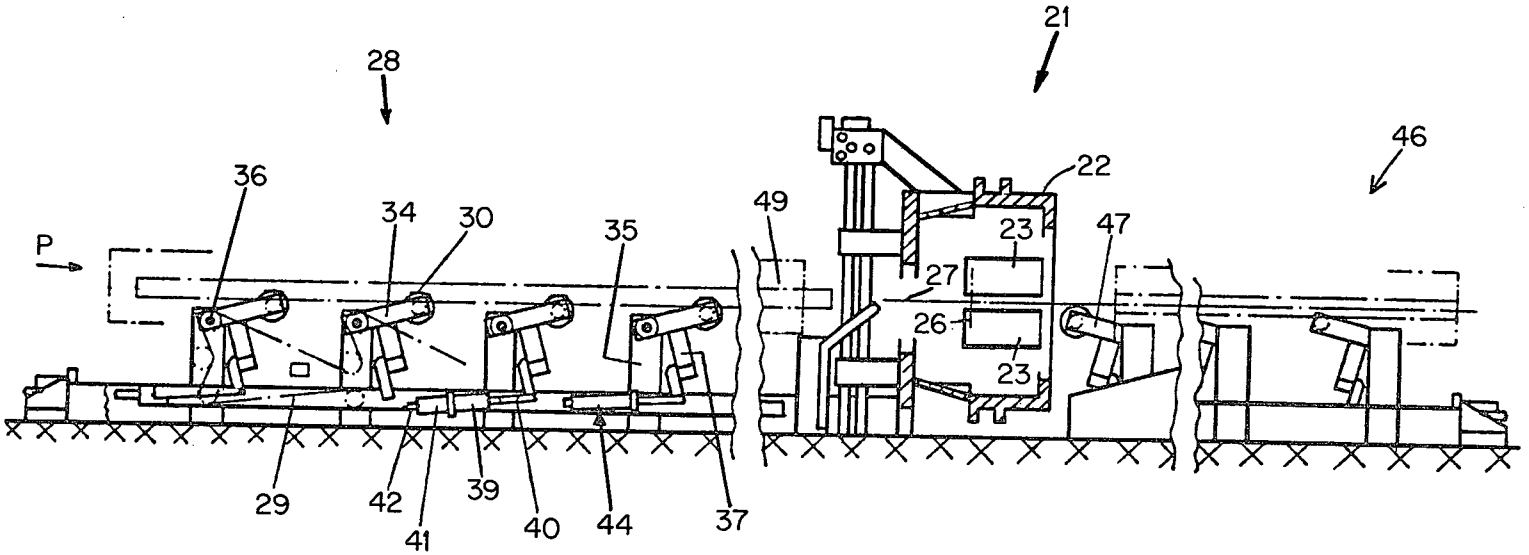
FIG. 8 is a side view of the apparatus of FIG. 2 but in more detail.
Figure 9:
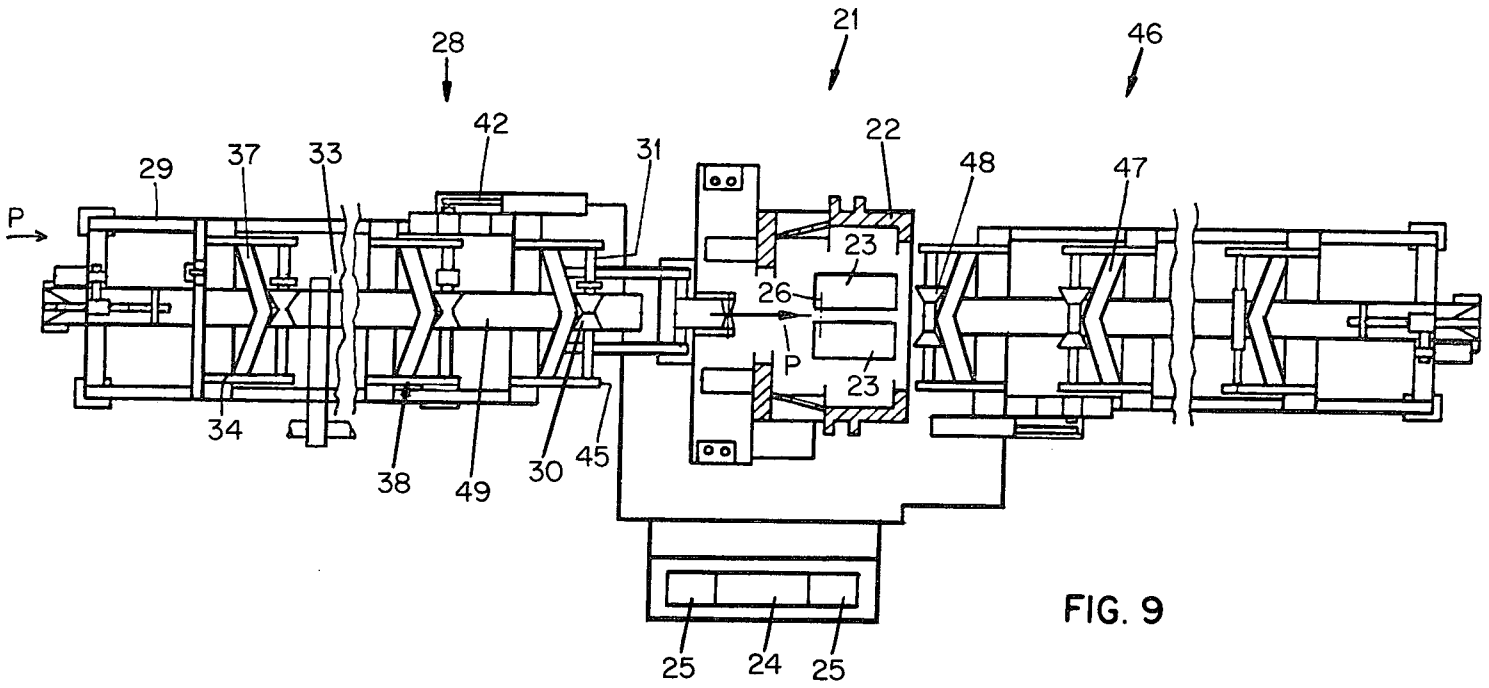
FIG. 9 is a top view of the apparatus of FIG. 8.

According to FIGS. 8 and 9 there is a central calibrating unit 21 which has calibrating jaws 23 disposed radially around a center axis in a frame 22 which are jointly shiftable in a radial direction of an opening or closing movement so that the diameter of a pipe section introduced in the direction of the arrow P is reduced by compression by the closing movement of the jaws 23. A not quite round pipe section is correspondingly aligned. The common drive of the jaws 23 for the radial opening and closing is not shown in the drawing and may be assumed as substantially known. An electric motor 24 and a hydraulic unit which controls the movement of the jaws 23 have been provided for the drive. A driving unit 24 and 25 is provided so that the normal closing movement of the jaws, which takes place at a great speed, is replaced, after an interim stop in a second phase, by a closing movement carried out at a throttled speed. Accordingly the completely opened jaws 23 are first brought together at great speed and upon contact with the pipe section are stopped instantly by the sensors 26. The change-over to the second phase takes place through these sensors 26 which, with regard to the center axis 27, are disposed in the axial direction on diametrically opposite jaws. When the sensors 26 touch the introduced pipe section to be aligned and calibrated, they cause an interruption of the closing movement of the jaws and change the hydraulic unit 25 over so that the jaws 23 are again compressed at a low speed. During the real alignment and calibration of the pipe section, e.g., the prescribed ideal dimension, the closing speed of the jaws is considerably reduced. A further function of the sensors 26 provides control of the brakes, as described hereinafter.

A feed mechanism 28 in front of the central calibrating mechanism 21 is shown on the left side of FIGS. 8 and 9 and a discharge mechanism 46 on the right side. The feed mechanism 28 consists of a bottom frame 29 which is developed for the reception of the entire pipe section to be processed and has a considerable length, e.g., 9 to 10 meters. Driven feed rolls 30, disposed jointly on carrying axle 31 running perpendicularly to the direction of feed, are provided for the reception, support and conveyance of the pipe section. The feed rolls 30 are shiftably mounted axially on the carrying axles 31 and are interconnected with the aid of a loose central rope 33 in such a way that, upon tightening of the centering rope, each feed roll 30 assumes the center position on the axle 31. Upon loosening of the rope 33 the feed rolls 30 may be shifted freely on their axles 31.

Each axle 31 is mounted at an end in a bracket 34, which brackets 34 are swivelably anchored in a vertical carrier 35. The swivelling point is designated by reference numeral 36. Two arms 34 are disposed on the same axle 31 and are interconnected by a V shaped double arm 37 so that one swivelable tilting table 38 is formed by the arms 34 and 37 respectively. The feed rolls 30 are swivelled in the vertical plane by the tilting movement of the tilting table 38.

Tilting table 38 is under the influence of a pneumatic or hydraulic power activating unit and a brake 44, which brake slows and brings to a stop the tilting movement. The pneumatic or hydraulic unit comprises a first air cylinder 39 with piston and piston rod 40 and a second cylinder 41 with piston and piston rod 42 which is attached swivelably with its free end to the bottom frame 29 as shown in FIGS. 8 and 9. The two cylinders 39 and 41 are disposed in a joint housing from which the piston rod 40 of the first cylinder 39 extends in an opposite direction to the piston rod 42 of the second cylinder 41 and is connected with the V shaped point of the double arm 37. The first cylinder 39 is dimensioned so that the extended piston rod is capable of bearing its share of the pipe weight and an additional 10% of the pipe weight while the second cylinder 41 has a somewhat smaller load capacity which is about 10% less than its share of the pipe weight. In the position shown in FIG. 8 the piston in the first cylinder is acted upon by air or fluid and the piston rod 42 is extended while the second cylinder 41 is without air or fluid. The corresponding pressure for the cylinders must be adapted to the pertinent weight of the pipe. The height adjustment of the feed rolls for the various pipe diameters is accomplished by a motor driven adjusting unit.

Each tilting table 38 is provided with a brake 44 which can stop the tilting table in any position. In the area of the feed rolls 30 barriers 45 are provided which control the air or fluid supply for the pneumatic or hydraulic units. The operation of the brakes 44 is coupled with the feed mechanism and the sensors 26 so that, prior to the start of the feed, the brakes tighten and with the operation of the sensors 26 the brakes are released. There is also a secondary connection of the brakes with attachment of the jaws 23 so that, during the opening of the jaws, the brakes are applied for stopping the tilting tables.

The discharge mechanism, which extends on the other side of the central calibrating mechanism 21 equiaxially to the feed mechanism 28, is provided with vertically movable feed rolls 48 in tilting tables 47 by means of which the calibrated and aligned pipe sections are discharged.

The pipe section 49 which is to be processed is primarily made from strip metal shaped material and must be calibrated and aligned since after production it is irregular both in diameter and longitudinal extent. The pipe section 49 is placed parallel to the feed mechanism 28 onto the feed rolls 30 as shown in FIGS. 8 and 9. The pipe section 49, which previously was in the starting position, lies on an axis corresponding to the calibration axis whereby the barriers 45 are interrupted to slow the travel of the pipe section. The interruption of the barriers 45 also causes the cylinder 41 to receive air or fluid.

Thereafter the pipe section 45 is moved on by the driven feed rolls 30 toward the central calibrating mechanism 21. Upon the start of the feed the brakes 33 are operated, as a result of which the tilting tables 38 are held in a fixed position. The feed rolls 30 may therefore no longer be moved vertically but are horizontally shiftable on the common central horizontal axis.

The first feed period ends when the end of the pipe section is brought to the open calibrating jaws 23. For the purpose of aligning and calibrating, the drive of the calibrating jaws 23 is put into operation whereupon the jaws will move at a relatively great speed into the closing position. As soon as the sensors 26 of the calibrating jaws 23 come into contact with the intermediate pipe section, the closing movement of the calibrating jaws 23 is interrupted. At the same time the brakes 33, which block the tilting tables 38, are released. Thereafter the closing movement of the calibrating jaws 23 is continued in a second phase at a substantially reduced speed so that the pipe section is first aligned and subsequently calibrated. Upon reaching the desired diameter, the opening of the calibrating jaws 23 is achieved by a proximity switch. This proximity switch controls the drive of the jaws 23 correspondingly to the nearness of the jaws to the pipe section. In a forward mode, the proximity switch causes the brakes 44 to be tightened and the tilting tables 38 to be blocked. The feed rolls 30, therefore, may no longer move vertically but may only shift horizontally on the pertinent carrier axles 31. Subsequently the feed is started again and an additional section of the pipe is fed to the central calibration unit. Since the real alignment of the pipe section and the subsequent calibration does not start promptly at a great speed, but at a substantially throttled speed, of the jaws, no undue bending stresses and surface pressures occur. Furthermore, the free end of the pipe section will move gently as a result of simultaneous shifting of the feed rolls 30 on the carrier axles 31. The completely calibrated and aligned pipe section is then fed to the feed rolls 48 of the discharge mechanism 48.

For discharge, the aligned and calibrated pipe section comes to lie on the rolls 48 which, with progressing feed, are swivelled successively from a lower rest position into a higher carrying and feed position. This movement may again be controlled by proper barriers and may be triggered by pneumatic or hydraulic means.

Prior to feeding in a new pipe section, the feed rolls 30 are moved into the middle position by tightening of the centering rope 33. As soon as the new pipe section rests on the rolls 30 the rope 33 is relaxed so that the feed rolls 30 may adjust themselves laterally in the horizontal plane. Subsequently the alignment and calibration of the pipe section takes place in the manner described above.

The graph of FIG. 1 illustrates the 5 different stages of movement of the jaws by means of the lines illustrating:

(1) movement from initial time A to point B where first contact is made with the proximity switch in the closing movement, the slope between A and B representing distance (Y axis) units divided by time (X axis) units with the value being higher;

(2) movement from point B to point C where the brakes are applied and the slope is less than in (1);

(3) movement from point C to point D where alignment occurs and the slope has a lower value;

(4) movement from point D to point E where the decelerating movement is steep; and (5) the complete cessation of movement at point E.

Having thus disclosed the invention, I now claim:

1. Calibrating apparatus for inside and outside calibration of pipe sections and for alignment of a calibrated pipe section with a calibrated preceding pipe section comprising:

a feed mechanism including feed rolls for moving successive pipe sections onto a tilting table and into a calibrating unit for measurement and alignment;

a tilting table for supporting the pipe section being calibrated;

said feed rolls being horizontally movable on said tilting table;

calibrating jaw means including opposing jaws to encircle the pipe section on said tilting table;

adjustable mounting means for said feed rolls and calibrating jaw means comprising a swivelable mount for said feed rolls, hydraulically actuatable cylinder and piston means abutting said feed rolls and sensor means coacting with the pipe section passing through said feed rolls to adjust the pressure of said rolls in response to the closing movement of the calibrating jaws to block any movement thereof;

braking means responsive to said sensor means for stopping the tilting movement of said tilting table, said braking means including a secondary connection means to the calibrating jaws which are adapted to stop the closing movement of said jaws when the tilting table movement is blocked; and a discharge means in alignment with said calibrating jaw means and said feed rolls which discharges calibrated pipe sections after alignment with a preceding pipe section.

2. Calibrating apparatus as claimed in claim 1 wherein said hydraulically actuatable cylinder and piston means comprises a pair of cylinders fitted with a first and second piston and piston rod, said piston rods being attached by a swivelable connection at their free ends.

3. Calibrating apparatus as claimed in claim 2 wherein said pair of cylinders is a double cylinder in which one of the cylinders provides a thrust which is weaker than that of the other cylinder of said pair.

4. Calibrating apparatus as claimed in claim 3 wherein said feed rolls are provided with barrier means to slow the feed of pipe sections to said feed rolls.

5. Calibrating apparatus as claimed in claim 4 wherein said barrier means includes connecting means to slow the feeding action of the one of said double cylinders which has the weaker thrust.

6. Calibrating apparatus as claimed in claim 5 wherein said calibrating jaw means includes a driving unit comprising an electric motor and a hydraulic unit adapted to facilitate several stages of closing of said jaws, each successive stage being at a slower speed than the preceding stage.

7. Calibrating apparatus as claimed in claim 6 wherein said hydraulic unit attached to the jaws includes sensors which register jaw pressure and which are adapted to stop the closing movement at a predetermined pressure.

8. Calibrating apparatus as claimed in claim 7 wherein the contact of the calibrating jaws against the pipe section at said predetermined pressure unblocks the tilting movement of the tilting table to thereby facilitate the opening of said jaws.

9. Calibrating apparatus as claimed in claim 8 wherein the unblocking of the tilting table movement by said secondary connection means which precedes the opening of said jaws is followed by a blocking movement after alignment with the preceding pipe section.

10. Calibrating apparatus as claimed in claim 9 wherein said blocking and unblocking of the tilting movement of the table by said secondary connection means cooperates with the braking movement to assure reliable calibration and alignment.

11. Calibrating apparatus as claimed in claim 10 wherein said calibrating jaw means are provided with a proximity switch which responds to a predetermined proximity position of the jaws relative to said pipe section, said proximity switch stopping the movement of said jaws toward said pipe section.

12. Calibrating apparatus as claimed in claim 11 wherein the combination of the blocking movement of said tilting table and the stopping of said feed rolls in the vertical direction confines the shifting of the feed rolls in the horizontal plane of said tilting table whereby the free end of the pipe section gently moves forward along the axis of alignment.

13. Calibrating apparatus as claimed in claim 12 wherein said hydraulically actuatable cylinder and piston means provides a retarded rate of movement which is further controlled by said barrier means to permit a slower feeding stage at the barrier means than at the entry of a new pipe section into the feed rolls.

14. Calibrating apparatus as claimed in claim 13 wherein the apparatus includes a centering rope along the central longitudinal axis of the tilting table and feed rolls and discharge means, said centering rope aiding the alignment of an incoming pipe section.

* * * * *